US007681257B1

(12) United States Patent
Broersma

(10) Patent No.: US 7,681,257 B1
(45) Date of Patent: Mar. 23, 2010

(54) ROTATING LENS LOCKING DEVICE

(75) Inventor: Lester V. Broersma, San Diego, CA (US)

(73) Assignee: JT Sports, LLC, Bentonville, AR (US)

( * ) Notice: Subject to any disclaimer, the term of this patent is extended or adjusted under 35 U.S.C. 154(b) by 834 days.

(21) Appl. No.: 11/511,865

(22) Filed: Aug. 28, 2006

Related U.S. Application Data

(60) Provisional application No. 60/740,616, filed on Nov. 29, 2005.

(51) Int. Cl.
*A63B 71/10* (2006.01)

(52) U.S. Cl. ..... 2/425; 2/431

(58) Field of Classification Search ..... 2/9, 2/424, 425, 431, 447, 448
See application file for complete search history.

(56) References Cited

U.S. PATENT DOCUMENTS

| | | | | | |
|---|---|---|---|---|---|
| D277,520 | S | | 2/1985 | Gregory | D2/233 |
| 4,555,816 | A | | 12/1985 | Broersma | 2/425 |
| D284,327 | S | | 6/1986 | Gregory et al. | D2/233 |
| D285,381 | S | | 9/1986 | Dawson et al. | D2/233 |
| 4,612,675 | A | | 9/1986 | Broersma | 2/424 |
| 4,625,341 | A | | 12/1986 | Broersma | 2/424 |
| 4,627,115 | A | | 12/1986 | Broersma | 2/425 |
| 4,748,697 | A | | 6/1988 | Hodnett | 2/438 |
| 4,885,806 | A | * | 12/1989 | Heller | 2/423 |
| 4,901,373 | A | | 2/1990 | Broersma | 2/421 |
| 4,903,348 | A | | 2/1990 | Broersma | 2/421 |
| 5,119,516 | A | | 6/1992 | Broersma | 2/411 |
| 5,123,121 | A | | 6/1992 | Broersma | 2/421 |
| 5,148,550 | A | | 9/1992 | Hodgkinson et al. | 2/424 |
| 5,269,025 | A | | 12/1993 | Broersma | 2/411 |
| 5,309,576 | A | | 5/1994 | Broersma | 2/412 |
| 5,333,329 | A | * | 8/1994 | Hong | 2/424 |
| 5,351,341 | A | | 10/1994 | Broersma | 2/412 |
| 5,444,876 | A | | 8/1995 | Cooper et al. | 2/450 |
| 5,689,834 | A | | 11/1997 | Wilson | 2/436 |
| 5,809,580 | A | | 9/1998 | Arnette | 2/426 |
| 6,047,409 | A | * | 4/2000 | Simpson | 2/424 |
| 6,047,410 | A | | 4/2000 | Dondero | 2/426 |
| 6,085,357 | A | | 7/2000 | Broersma | 2/416 |
| 6,154,881 | A | * | 12/2000 | Lee | 2/9 |
| 6,381,749 | B1 | | 5/2002 | Cyr | 2/9 |
| 6,467,098 | B1 | | 10/2002 | Lee | 2/443 |
| D487,534 | S | | 3/2004 | Broersma | D29/108 |
| 6,874,169 | B2 | | 4/2005 | Broersma | 2/423 |
| 6,886,183 | B2 | | 5/2005 | DeHaan et al. | 2/6.7 |

* cited by examiner

*Primary Examiner*—Katherine Moran
(74) *Attorney, Agent, or Firm*—Keisling Pieper & Scott PLC; Meredith K. Lowry; David B. Pieper

(57) ABSTRACT

A head shield device having a frame and a replaceable lens. An engagement axle having an large dimension and a small dimension is attached to the frame. The lens defines an aperture with a neck and an enlarged inner body. The small dimension of the axle is adapted to pass through the neck and rotation of the axle to the large dimension locks the lens in place on the frame. The axle rotation is controlled by a control device located on a tab assembly forming the engagement axle.

12 Claims, 10 Drawing Sheets

ROTATING LENS LOCKING DEVICE

CROSS-REFERENCE TO RELATED APPLICATIONS

This application claims priority to and is a continuation-in-part of U.S. provisional application Ser. No. 60/740,616, filed Nov. 29, 2005.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

This invention relates to a shield apparatus to be worn by an individual to protect his forehead, eyes, nose, mouth, ears and the top of his head from projectiles thrown or shot at the wearer. More particularly, it relates to a shield apparatus of the described type which is molded of a plastic material, is light-weight and inexpensive in comparison to helmet-type protective head gear which primarily protects only the head and not the face. The shield device is designed to include a removable eye shield. The eye shield can easily be removed to allow a user to exchange eye shields or to clean the eye shield. An eye shield can then be inserted into the shield device. The shield device is designed so that the eye shield can not be removed while the shield device is in use on the wearer.

2. Description of the Known Art

Protective head gear or helmets are worn for safety reasons by many individuals on their jobs and in playing many sports. In particular, most construction workers are required to wear "hard hats," one example of the many different types of protective head gear. In some instances workers wear both a hard hat and safety goggles to protect their heads and eyes from injury. In sports, football for example, the players wear football helmets to protect their heads. The same is true with hockey players. They generally wear face masks. These head gears and/or face masks generally protect either the head or face, but not both. Furthermore, they do not protect both the face and head from objects thrown or shot at the wearer. Recently, paint ball, another sport, has increased in popularity. During this game the players shoot paint pellets at one another. These paint pellets travel at a relatively high velocity, and if a player is hit in the face by one of them, serious injury can result. Helmets designed to protect the head from injury will not protect the face in such cases, and those designed to protect the face do not protect the head.

Details of different types of masks are outlined in U.S. Pat. No. 6,886,183 issued to DeHaan et al. on May 3, 2005; U.S. Pat. No. 6,467,098 issued to Lee on Oct. 22, 2002; U.S. Pat. No. 6,381,749 issued to Cyr on May 7, 2002; U.S. Pat. No. 6,047,410 issued to Dondero on Apr. 11, 2000; U.S. Pat. No. 5,809,580 issued to Arnette on Sep. 22, 1998; U.S. Pat. No. 5,689,834 issued to Wilson on Nov. 25, 1997; U.S. Pat. No. 5,444,876 issued to Cooper et al. on Aug. 29, 1995; U.S. Pat. No. 5,148,550 issued to Hodgkinson et al. on Sep. 22, 1992; and U.S. Pat. No. 4,748,697 issued to Hodnett on Jun. 7, 1988. Each of these patents is hereby expressly incorporated by reference in their entirety. Several of these patents describe different areas of the various arts as noted by the following comments.

U.S. Pat. No. 6,886,183 issued to DeHaan et al. on May 3, 2005 discusses a goggle frame and lens assembly in which a secure assembly and disassembly is provided by the tab retention system including a plurality of tabs and mating tab retention holes, a central stability tab and a flush fit between the tabs and the goggle frame when the lens is secured within the front gutter of the frame.

U.S. Pat. No. 6,467,098 issued to Lee on Oct. 22, 2002 discusses goggles with removable lenses comprising a pair of soft lens rim each with a lens and a cushion in sucker format is formed with the soft lens rim into one body. Two soft lens rims are tied together with a bridge, the soft lens rims and the bridge are formed into one body with soft plastic. A groove in stair shape for the fixing ring and a hole for the fixing mechanism are inside the soft lens rim for a lens.

U.S. Pat. No. 6,381,749 issued to Cyr on May 7, 2002 discusses a protective mask adapted to be worn by persons engaging in physical games comprises a body consisting of a lens receiving portion. The lens receiving portion displays an opening which is covered by a removable flexible transparent lens having its opposite extremities configured with engagement portions that mount the lens to the body. A pair of anchor clamps is inserted at each opposite end of the lens to further secure the engagement of the lens to the mask body. The lens receiving portion defines an opening and includes first engaging means adjacent each opposite side end of the opening. The lens has, at each opposite side end, second engaging means adapted to snapingly engage the first engaging means; the lens is flexible in a direction enabling distance variation between the side ends thereof so that manual pressure exerted on the lens causes the lens to snapingly engage with or to disengage from the first engaging means; and removable anchor means mounted at each opposite side end of the lens receiving portion and insertable at the opposite side ends of the lens to further secure the first and second engaging means together in an engagement position. In one form of the invention, the removable anchor means are shaped, on the one hand, to fittingly receive the ends of the lens and, on the other hand, with a slot to receive therethrough the strap that serves to mount the mask to the user's head.

U.S. Pat. No. 6,047,410 issued to Dondero on Apr. 11, 2000 discusses a goggle system comprised of a lens having a series of notches which interfit with posts, two of which are seen as small cross members in a lens slot which supports and interfits with the edge of the lens. Lens slot exists in both the upper frame and the lower frame. The posts are used to better help the lens to interlock into the upper and lower frames. U.S. Pat. No. 5,809,580 issued to Arnette on Sep. 22, 1998 discusses a multi-sport goggle having a tear-away lens system comprising a "permanent" lens having opposite side edges is provided which fits within grooves formed along the top and bottom frame extents. Permanent lens is first placed into the frame as described above, with the side edges of the lens lying over the outwardly facing surfaces of side extents. Once lens is in place on frame, brackets are secured to areas as described, with top wall portions extending over lens. Each outer-most lens further includes a first pair of holes at the opposite ends of the front pane which may be aligned with and passed over knobbed posts thereby removably securing the stack of outer-most lenses over permanent lens. The lateral pull-straps are secured to one side of the goggle frame, in the manner described below, such that the wearer can successively pull at the outer-most strap, lifting the outer-most lens off of posts and thereby revealing a clean lens therebeneath as needed.

U.S. Pat. No. 5,689,834 issued to Wilson on Nov. 25, 1997 discusses goggles with a front wall frame having a lens aperture for receiving a lens assembly that would cover both the wearer's left and right eyes. A lens groove removably receives the peripheral edge of lens assembly. Goggles also have a rear frame member. Rib members have their rear ends connected to rear frame member and their front ends connected to front wall frame.

U.S. Pat. No. 5,444,876 issued to Cooper et al. on Aug. 29, 1995 discusses protective eyewear having a wrap-around type lens and a frame which surrounds the upper and side edges of the lens. The frame includes a slot to receive the lens, and the slot has spaced pawls within the slot. The lens includes mating detents within the face of the lens to receive the pawls and thus retain the lens to the frame.

U.S. Pat. No. 5,148,550 issued to Hodgkinson et al. on Sep. 22, 1992 discusses fastener means using a pair of studs affixed to the side portions with ends which are rotatable to lock and release the lens. The lens has a pair of slots formed in it for receiving therethrough the studs and once the studs are extended through the slots, the ends and are rotated to lock the lens in place. A safety lock in the form of a wire is provided for each of the studs to prevent the lens from being inadvertently detached from the field mask. The wires are extended through apertures formed in the ends of the studs and prevent the lens from being detached if the ends of the studs are rotated to a position which would permit the studs to disengage from the slots in the lens through which the studs extend.

U.S. Pat. No. 4,748,697 issued to Hodnett on Jun. 7, 1988 discusses a face mask which is characterized by a soft rubber or plastic cowl provided with a track insert having pair of tracks spanning an open lens window for receiving a transparent lens slidably mounted in the tracks and closing the lens window. In a preferred embodiment, the lens is a tear-away lens connected at a perforated interface to the next one of several additional lenses wound in end-to-end relationship in a roll, which roll is located inside a canister attached to the track insert of the face mask. Each lens is individually, selectively and sequentially extended through a slot in the canister and through the parallel lens tracks to a track lip projecting from the opposite side of the track insert, when the preceding lens is damaged or coated so as to adversely affect visibility and is removed from the lens tracks. When the damaged lens is slidably extended from the lens tracks in the face mask for removal, a second lens is unrolled from the canister and slidably positioned over the lens window and the damaged lens is torn from the leading edge of the newly positioned lens at the perforated interface between the lenses.

These prior art patents fail to teach the eye shield that can be releasably attached to a frame for a shield apparatus for quick cleaning and replacement and the other advantages of the present invention. Thus, it may be seen that these prior art patents are very limited in their teaching and utilization, and an improved shield apparatus is needed to overcome these limitations.

SUMMARY OF THE INVENTION

The present invention is directed to an eye shield that is quickly and easily removed and replaced into a head shield for cleaning and/or replacement of the eye shield. The eye shield is formed from a shaped translucent or transparent material with an end receiving aperture provided on at least one end of the eye shield such that the eye shield may be inserted onto a shaft of an engaging lock. The end receiving aperture in the eye shield has an enlarged internal end and the engaging lock shaft has a narrow profile in one direction and an enlarged profile in another direction. Once the eye shield has been inserted onto the narrow profile of the shaft, the shaft is rotated such that the enlarged profile fills into the enlarged internal end of the eye shield so that the eye shield cannot be removed from the shaft. Subsequent removal of the eye shield merely requires rotation of the shaft back to the narrow profile. A lock system for the handle that operates the shaft ensures that the eye shield does not become dislodged during actual use of the eye shield. The lock system uses a tab and aperture system as a lock, and uses a raised guard to ensure that random encounters with foreign objects are deflected over the handle to avoid unintentional operation of the lock. Furthermore, operation of the handle lock is done using the internal space of the head shield such that the lock operation is only performed when the user is not wearing the head shield.

The shield apparatus of the present invention is extremely suitable for use by individuals playing paint ball, as well as any type of job-related or sport-related activity in which a user would need to protect both his face and his head, as will be apparent from the description below.

The shield apparatus is strong, light-weight, and relatively inexpensive in comparison to helmets which protect only the head and face masks which protect only the face. The shield apparatus is molded of a plastic material such as virgin ABS or virgin nylon, depending on its specific use and the strength required. In some cases, it is preferred to use the virgin nylon because of its strength and its flexibility. For example, in playing paint ball, if the shield apparatus is struck by a paint pellet traveling at a high velocity, it will absorb the impact and will not crack or shatter. The shield apparatus is vented and includes die-cut foam liners or padding for cushioning the face and head for comfort. The shield apparatus also has an eye shield that provides a wide field of vision wherein the eye shield is easily removed and replaced if desired.

The shield apparatus includes an eye shield that defines a retention aperture. The aperture engagement device of the shield apparatus engages the retention aperture in order to secure the eye shield to the frame. The aperture engagement device can be manipulated so that an engagement bit of the aperture engagement device can be adjusted between a neck retain position and a neck release position. The eye shield can be removed from the frame or inserted into the frame when the engagement bit is in a neck release position. Once inserted, the eye shield cannot be removed from the frame while the engagement bit is in a neck retain position.

The user adjusts the engagement bit from a neck release position to a neck retain position by adjusting the user-operable lever that is adjustably attached to the frame. The user-operable lever includes a frame head. The frame head is adapted to secure the eye shield in an attached position during use of the shield apparatus. The aperture engagement device includes a retention device. The retention device limits the movement of the engagement bit. The retention device prevents the eye shield from being accidentally released from the frame while the shield apparatus is in use. The retention device can include a lock aperture or a retention impediment or both a lock aperture and a retention impediment. The lock aperture and/or the retention impediment restrict movement of the engagement bit in order to prevent release of the eye shield from the frame while the shield apparatus is in use.

It is therefore an object of the invention to provide an improved light-weight, inexpensive protective face and head gear which is adaptable for many different uses, whether it is job related or sports related.

More particularly still, it is an object of the invention to provide an improved protective face and head gear which protects both the face and head of the user.

Further, it is an object of the invention to provide a means for a user to more easily replace the eye shield of a shield apparatus.

Another object of the invention to provide a safety means for ensuring that the eye shield will not be released from the frame while the shield apparatus is in use.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

BRIEF DESCRIPTION OF THE SEVERAL VIEWS OF THE DRAWINGS

In the following drawings, which form a part of the specification and which are to be construed in conjunction therewith, like reference numerals have been employed throughout wherever possible to indicate like parts in the various views.

DETAILED DESCRIPTION OF THE INVENTION

Figure 1:
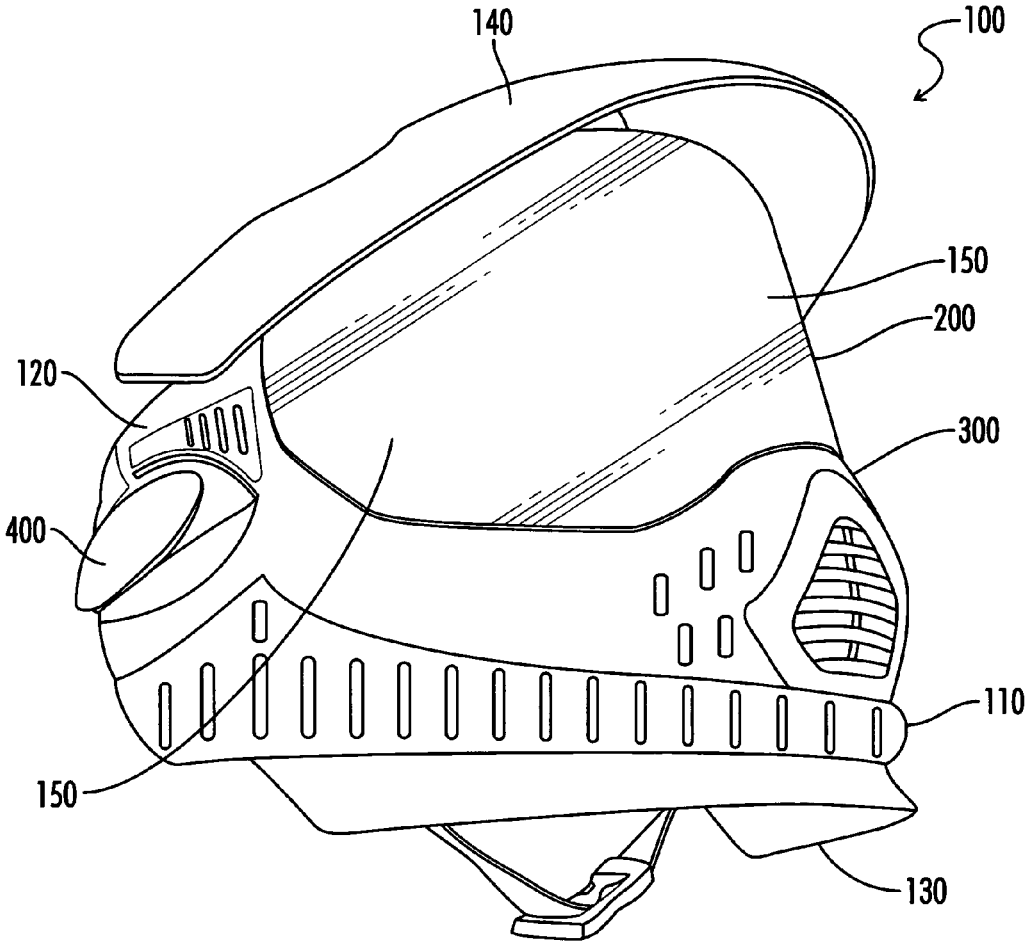
FIG. 1 displays a front left plan view of the shield device.

Referring now to the drawings, FIGS. 1 through 16 illustrate a shield device 100 having a bottom portion 110, side portions 120 and 130, an eye shield 200, and a top portion 140, all molded from a flexible and resilient plastic material. The top portion 140, side portions 120 and 130 are shaped so as to flow together to form a shell which extends across the top of the head and about the sides of the head. The bottom portion 110 covers the face and also covers a portion of the throat.

The eye shield 200 is placed in the frame 300 of the shield device 100 and extends around the respective side portions 120 and 130 so as to provide an opening 150 which gives the user a field of vision of approximately 180 degrees. The opening 150 is covered with an eye shield 200 which is releasably attached to the frame 300. A shield engagement device attached to the shield device 100 is in a position to accept the eye shield 200. The eye shield 200 has an engagement area for the engagement device to make contact in order to frictionally attach the eye shield 200 to the frame 300. The shield engagement device is designed so that it can frictionally attach the eye shield 200 with minimum effects on limiting the user's field of vision.

Figure 9:
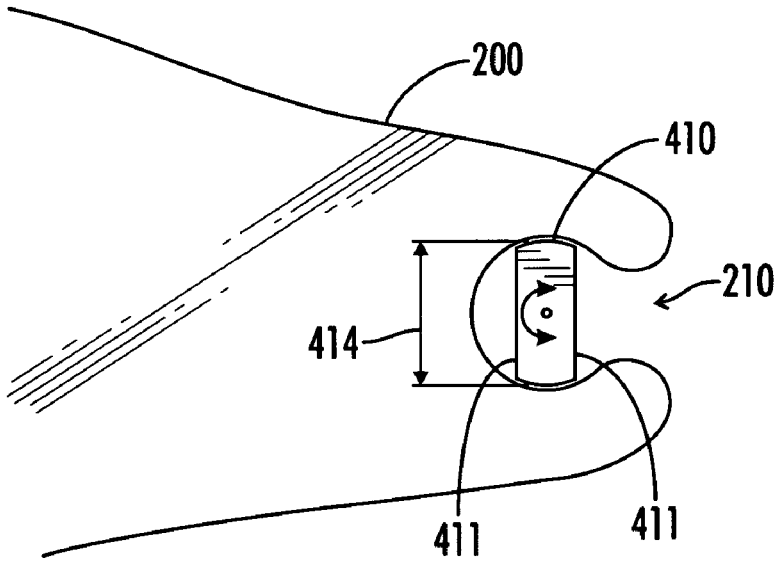
FIG. 9 displays a schematic illustration of the eye shield slot with the engagement bit in a neck retain position.
Figure 10:
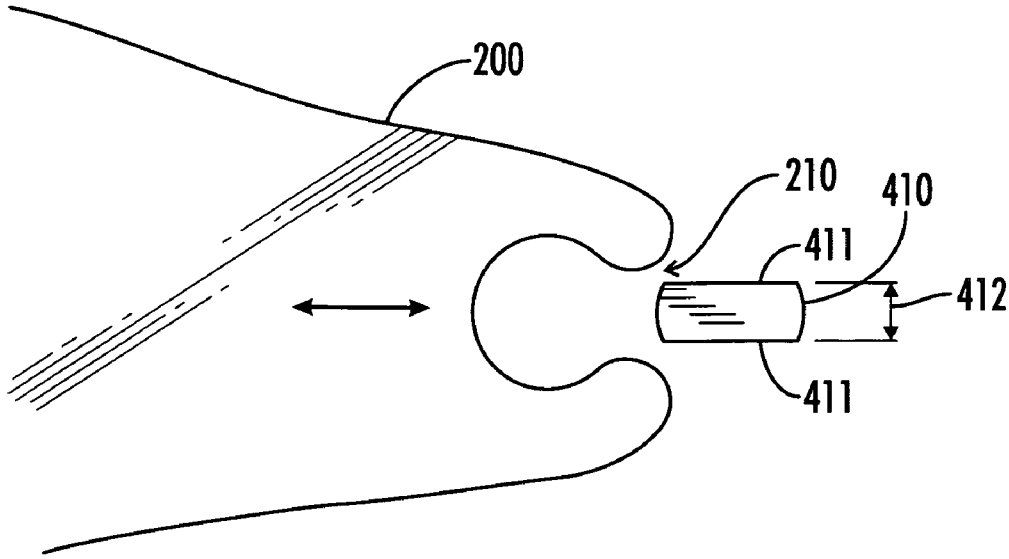
FIG. 10 displays a schematic illustration of the eye shield slot with the engagement bit in a neck release position.

For the present invention, an aperture engagement device 400 represents the shield engagement device. The aperture engagement device 400, as illustrated by FIGS. 1-10, comprises an engagement bit 410, a movement device 440, a user-operable lever 450, and a retention device 460. The engagement bit is a cylindrical shaft with two flats on the engagement portion of the shaft. The eye shield 200 has a retention aperture 210 formed in it for receiving the engagement bit 410. As shown in FIGS. 9 and 10, the flats 411 in the engagement bit 410 allow for it to pass within the engagement aperture 210 where the engagement bit 410 may then be rotated to hold the eye shield 200 in position. The retention aperture 210 of the eye shield 200 represents the engagement area of the eye shield 200. As shown in FIG. 9, once the engagement bit 410 is extended through the retention aperture 210, the engagement bit 410 can be adjusted to a neck retain position in order to secure the eye shield 200 to the frame 300.

Figure 2:
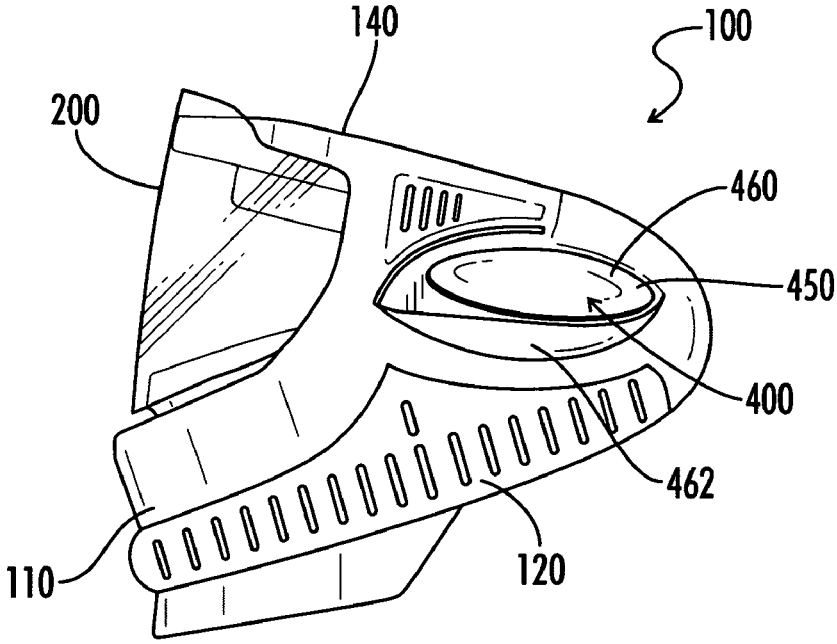
FIG. 2 displays a side plan view of the eye shield device.
Figure 3:
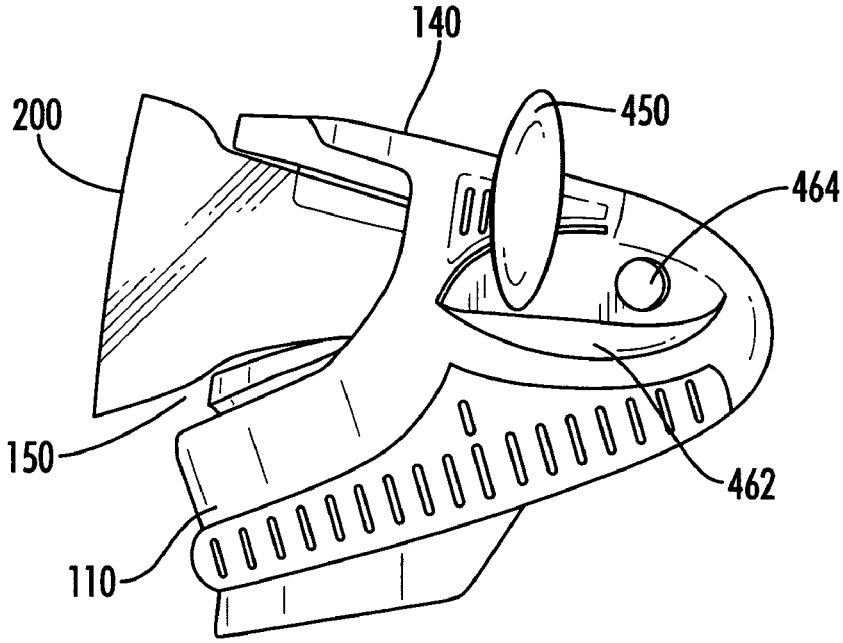
FIG. 3 displays a side plan view of the shield device with the eye shield in the released position.

Referring to FIG. 2, the shield device 100 includes an eye shield 200 in the attached position. The user-operable lever 450 of the aperture engagement device 400 is in a neck retain position as shown in FIG. 9. The aperture engagement device 400 is engaged with the retention aperture 210 of the eye shield 200. The eye shield 200 can not be removed from the frame 300 when the aperture engagement device 400 is in the neck retain position. Movement of the user-operable lever 450 is limited by a retention device 460. As shown in FIG. 3, the retention device 460 can include a retention impediment 462 that acts both as a stop for the lever 450 and as a deflector for foreign objects that might attempt to disengage the lever 450, a lock aperture 464 that securely locks the lever 450 in position, or both a retention impediment 462 and a lock aperture 464 as shown in the preferred embodiment.

Figure 5:
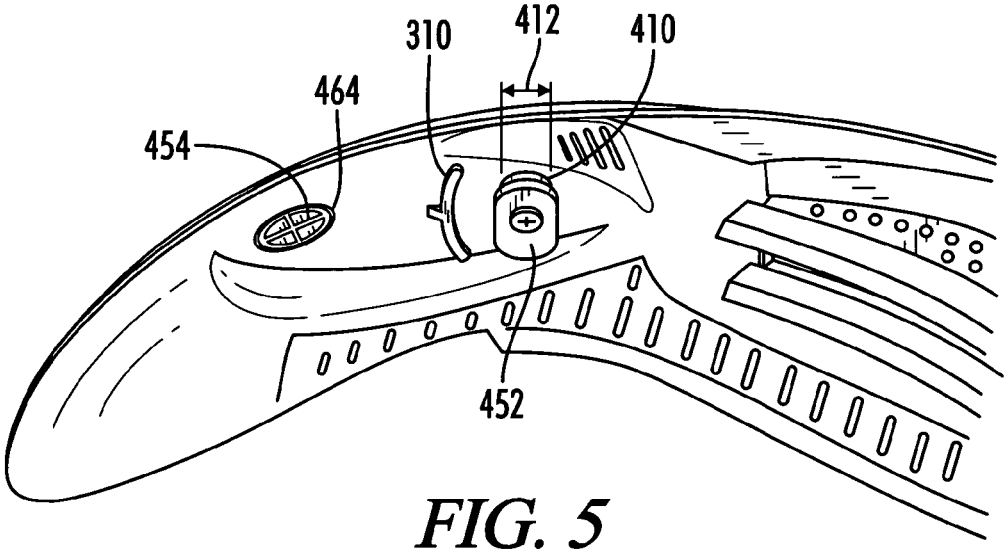
FIG. 5 displays a partial top view of the aperture engagement device in a neck retain position.
Figure 5A:
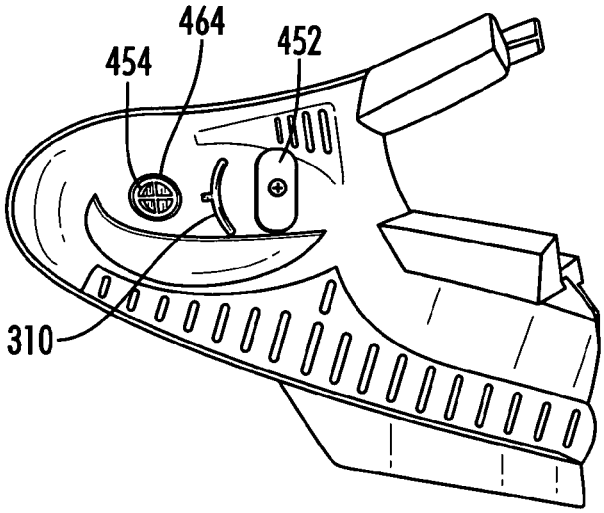
FIG. 5A is a partial side view of the device shown in FIG. 5.

As shown in FIGS. 5 and 5A, a retention bit 454 of the user-operable lever 450 is inserted into the lock aperture 464 when the user-operable lever 450 is placed into a neck retain position. The user operable lever 450 can not be adjusted until the retention bit 454 is removed from the lock aperture 464.

As seen in FIGS. 1 and 2, the retention impediment 462 limits the rotational movement of the user-operable lever 450. The user-operable lever 450 cannot easily be adjusted beyond the retention impediment 462. By limiting movement of the user-operable lever 450, the retention device prevents the eye shield 200 from being accidentally removed or displaced from the frame 300.

Referring to FIG. 3, the user-operable lever 450 is in a neck release position corresponding to the schematic of FIG. 10. The retention bit 454 of the user-operable lever 450 has been disengaged from the lock aperture 464 to allow rotation of the lever 450 and the connected engagement bit 410. The user-operable lever 450 has been adjusted in a direction away from the deflection and retention impediment 462 such that the impediment 462 will not restrict movement of the user-operable lever 450. As shown in FIG. 10, by adjusting the user-operable lever 450, the user has also adjusted the engagement bit 410. Referring to FIGS. 3 and 10, the aperture engagement device 400 is no longer engaged with the retention aperture 210 of the eye shield 200. Thus, the eye shield 200 can be removed from the frame 300 when the aperture engagement device 400 is in the neck release position.

In the adjustments, the rotational change may be seen in the engagement bit 410 from the neck retain position shown in FIGS. 2 and 9 to the neck release position of FIGS. 3 and 10. In the neck retain position, the engagement bit 410 secures the eye shield 200 to the frame 300. When the engagement bit 410 is in the neck retain position, the aperture neck 250 will not allow the engagement bit 410 to pass. The aperture neck 250 of the retention aperture 210 of the eye shield 200 will accept the engagement bit 410 when the engagement bit 410 is in the neck release position. The interaction between the aperture engagement device 400 and the retention aperture 210 will be described in greater detail below in discussions of FIGS. 7-8.

Figure 4:
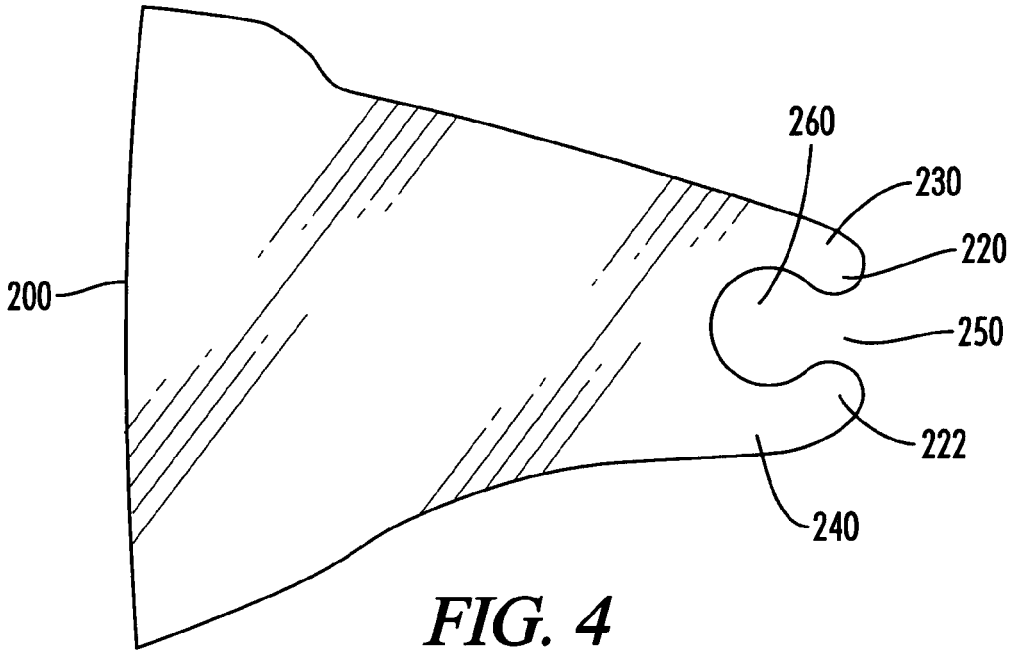
FIG. 4 displays a side plan view of the eye shield.

FIG. 4 displays a side plan view of the eye shield 200 with the detail of the upper arm 230, the lower arm 240, the upper finger 220, the lower finger 222, the aperture neck 250, and the enlarged aperture body 260. The fingers 220 and 222 of the eye shield 200 define an aperture neck 250. Relating to FIGS. 9 and 10 one may see that the aperture neck 250 is smaller than the engagement dimension 414 of the engagement bit 410. The aperture neck 250 is at least as large as the release dimension 412 of the engagement bit 410. The aperture neck 250 is sized so that the engagement dimension 414 of the engagement bit 410 can not pass through the aperture neck 250. The release dimension 412 of the engagement bit 410 can pass through the aperture neck 250.

The eye shield 200 is shaped such that it contains both an upper arm 230 and a lower arm 240. The arms 230 and 240 define an enlarged aperture body 260 inward from the aperture neck 250 formed by the upper finger 220 and the lower finger 222. The arms 230 and 240 include an inside bevel 231 along the interior of the aperture neck 250 allowing easier insertion of the engagement bit 410 between the arms 230, 240. The outside bevel 232 along the exterior of the fingers 220, 221 is larger than the inside bevel 231 preventing snagging of the engagement bit 410 when removing or inserting. The enlarged aperture body 260 is at least as big as the engagement dimension 414 of the engagement bit 410. The enlarged aperture body 260 is sized so that the engagement bit 410 can be rotated while the engagement bit 410 is inside of the enlarged aperture body 260.

Rotation of the engagement bit 410 allows different dimensions of the engagement bit 410 to come into contact with the aperture neck 250. Depending upon the dimension of the engagement bit 410 in contact with the aperture neck 250, the frame 300 can either release or retain the eye shield 200. If the engagement dimension of the engagement bit 410 is in contact with the aperture neck 250, the eye shield 200 cannot be removed from the frame 300. If the release dimension 412 of the engagement bit 410 is in contact with the aperture neck 250, the eye shield 200 can either be removed from the frame 300 or inserted into the frame 300.

FIG. 5 displays a partial top view of the aperture engagement device 400 in a neck retain position. The retention bit 454 of the user-operable lever 450 is engaged with the lock aperture 464 of the frame 300. The lock aperture 464 limits movement of both the user-operable lever 450 and the engagement bit 410. The engagement bit 410, the user-operable lever 450, and the frame head 452 are adjustably attached to the frame 300. The aperture engagement device 400 includes a movement device 440 that allows movement of the engagement bit 410, the user-operable lever 450, and the frame head 452. In a preferred embodiment, the movement device 440 is an axle adjustably secured to the frame 300. The movement device 440 allows the engagement bit 410 to be adjusted between the neck release position and the neck retain position.

Continuing to refer to FIG. 5, the engagement bit 410 is in a neck retain position. The engagement dimension 414 of the engagement bit 410 is in contact with the aperture neck 250 of the retention aperture 210. The frame head 452 is attached to the engagement bit 410. The frame head 452 is adapted to secure the eye shield 200 in an attached position during use of the shield application. FIG. 5A is a partial side view of FIG. 5.

Figure 6:
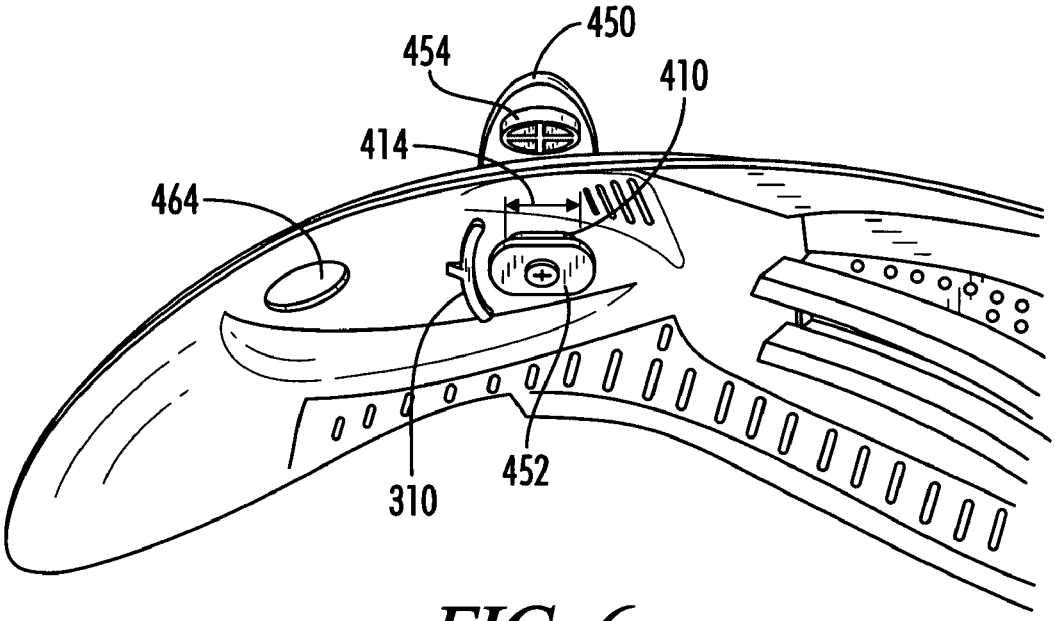
FIG. 6 displays a partial top view of the aperture engagement device in a neck release position.
Figure 6A:
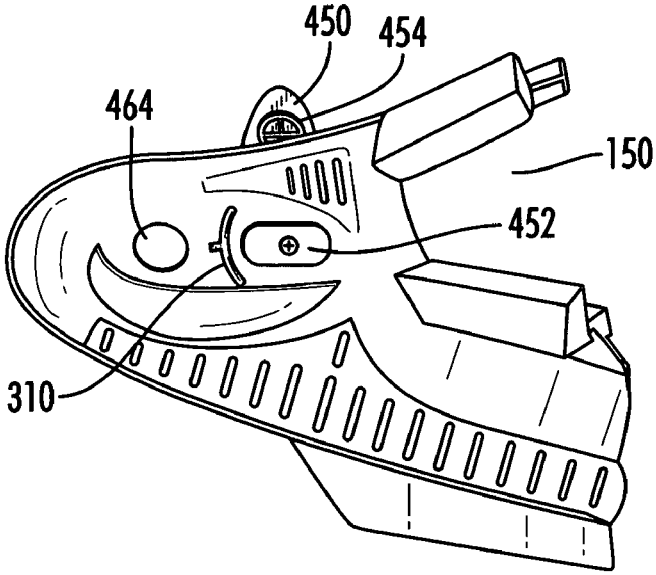
FIG. 6A is a partial side view of the device shown in FIG. 6.

FIG. 6 displays a partial top view of the aperture engagement device 400 in a neck release position. The release dimension 412 of the engagement bit 410 is in contact with the aperture neck 250. The user-operable lever 450 is no longer engaged with the lock aperture 464. Furthermore, the user-operable lever 450 has been adjusted away from the retention impediment 462. The user-operable lever 450 is adjusted by rotation of the user-operable lever 450 on the movement device 440. The movement device 440 can take many forms. The preferred embodiment is for the movement device 440 to be an axle secured to the frame 300. However, the movement device 440 is not limited to an axle secured to the frame 300. The engagement bit 410 can be adjusted through other methods known to one ordinarily skilled in the art. FIG. 6A is a partial side view of FIG. 6.

Figure 7:
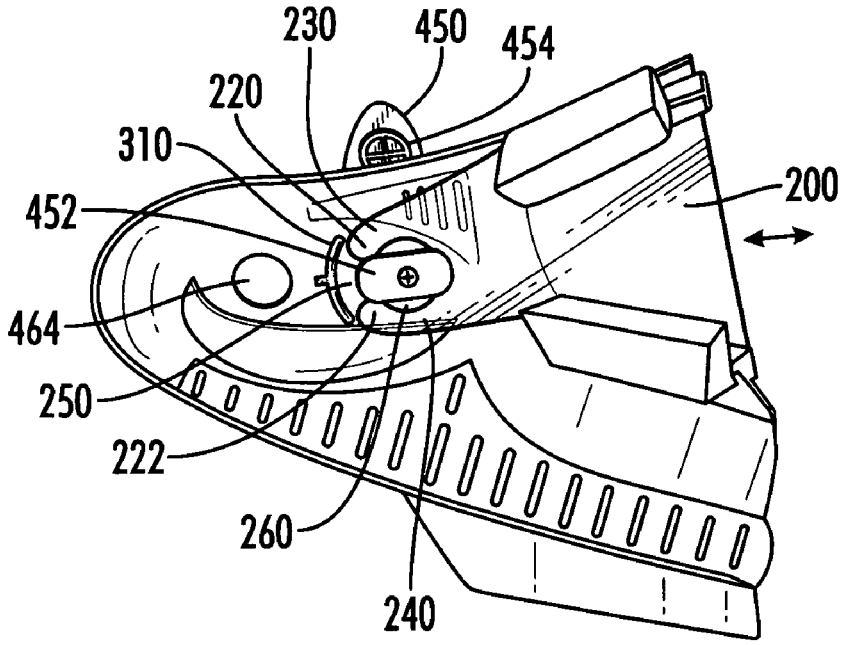
FIG. 7 displays a partial side view of the engagement bit of the aperture engagement device.
Figure 8:
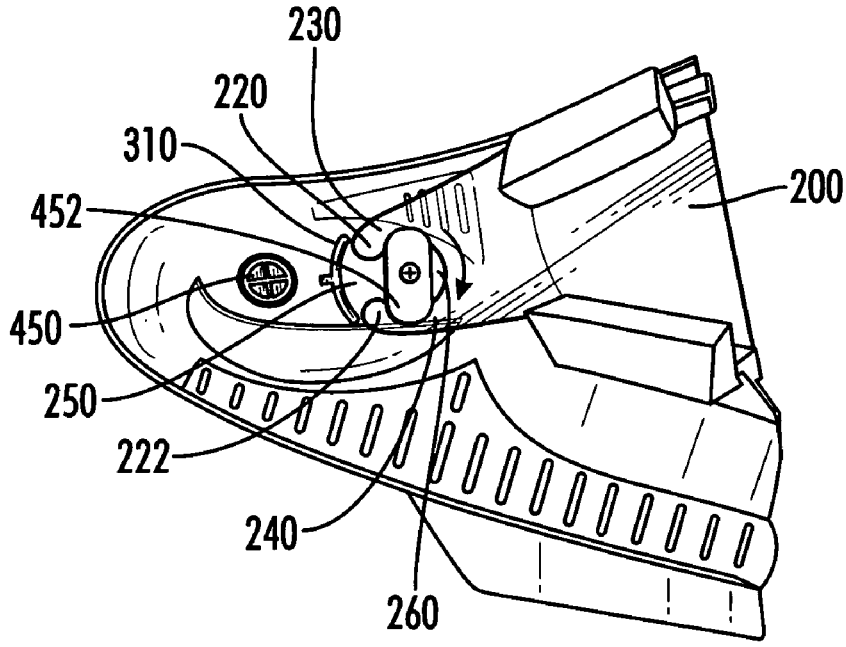
FIG. 8 displays a partial side view of the engagement bit of the aperture engagement device in a neck retain position.

FIGS. 7-8 demonstrate the rotational method of attaching the eye shield 200 to the frame 300. Referring to FIG. 7, the engagement bit 410 is adjusted to the neck release position. In the neck release position, the release dimension 412 of the engagement bit 410 is engaged with the aperture neck 250 of the retention aperture 210. The release dimension 412 allows passage of the engagement bit 410 through the aperture neck 250 of the retention aperture 210. The engagement bit 410 can be fully inserted into the enlarged aperture body 260 of the retention aperture 210 of the eye shield. As seen in FIG. 7, the eye shield 200 can only be advanced into the frame 300 as far as the attachment impediment 310 will allow the eye shield 200 passage onto the frame 300. The eye shield 200 will also be limited in its passage onto the frame 300 by the engagement bit 410 contacting the eye shield 200 after the engagement bit 410 is fully inserted into the large aperture body 260.

Continuing to refer to FIG. 7, one can see that because the engagement bit 410 is in a neck release position the eye shield 200 can also be removed from the frame 300. The release dimension 412 will allow passage of the engagement bit 410 through the aperture neck 250 in both removing and attaching the eye shield 200. To remove the eye shield 200, a user simply adjusts the engagement bit 410 so that the engagement bit 410 will be in a neck release position. The user can then remove the eye shield 200 from the frame 300.

To attach the eye shield 200, a user simply adjusts the aperture engagement device 400 to a neck release position. The user inserts the eye shield 200 into the opening 150 of the frame 300. The user inserts the eye shield 200 until the engagement bit 410 has fully passed through the aperture neck 250 and is in the enlarged aperture body 260. To secure the eye shield 200, the user then adjusts the engagement bit 410 so that it is in a neck retain position. While adjusting the engagement bit 410 into the neck retain position, the user can further limit movement of the engagement bit 410 by inserting the retention bit 454 of the user-operable lever 450 into the lock aperture 464.

Referring to FIG. 8, the engagement bit 410 has been adjusted to a neck retain position. The engagement bit 410 has been fully inserted into the enlarged aperture body 260. The enlarged aperture body 260 is large enough that the engagement bit 410 can be adjusted while inside of the enlarged aperture body 260. The enlarged aperture body 260 must be at least as large as the engagement dimension 414 of the engagement bit 410 so that the engagement bit 410 can be rotated while the engagement bit 410 is inside of the retention aperture 210.

The user-operable lever 450 has been adjusted to a neck retain position. By adjusting the user-operable lever to a neck retain position, the engagement bit 410 has also been adjusted to the neck retain position. In the neck retain position, the engagement dimension 414 is in contact with the aperture neck 250 of the retention aperture 210. The engagement dimension 414 does not allow passage of the engagement bit 410 through the aperture neck 250 of the retention aperture 210. The eye shield 200 can not be inserted onto the frame 300 while the engagement bit 410 is in the neck retain position because the engagement bit 410 cannot pass the aperture neck 250 of the retention aperture 210. Furthermore, the eye shield 200 can not be removed from the frame 300 while the engagement bit 410 is in the neck retain position because the engagement bit 410 cannot pass the aperture neck 250.

The retention bit 454 of the user-operable lever 450 has been inserted into the lock aperture 464 of the frame 300. By placing the retention bit 454 into the lock aperture 464, the user has limited movement of both the engagement bit 410 and the user-operable lever 450. By limiting the movement of both the engagement bit 410 and the user-operable lever 450, the user has ensured that the eye shield 200 will not be released from the frame 300 while the shield device 100 is in use.

To remove the eye shield 200, a user must adjust the aperture engagement device 400 into a neck release position. The release dimension 412 of the engagement bit 410 will be in contact with the aperture neck 250. A user will detach the eye shield by passing the aperture neck 250 over the engagement bit 410. After the aperture neck 250 passes the engagement bit 410, the eye shield 200 is no longer attached to the frame 160 and the eye shield 200 can be removed from the shield device 100.

FIGS. 9 and 10 illustrate the difference between the engagement dimension 414 and the release dimension 412. The differences between the two dimensions allows the eye shield 200 to be secured to the engagement bit 410 so that the eye shield 200 will not be released until the release dimension 412 is aligned with the length of the aperture neck 250 of the retention aperture 210. The release dimension allows the retention aperture 210 of the eye shield 200 to be inserted and removed from the engagement bit 410.

Note from FIG. 1 through 10 that the shield device 100 also has a number of air vents formed in it to provide air circulation through the shield device 100. These air vents can be in the form of elongated, spaced-apart slots, as illustrated, or another suitable shape to provide air flow into the shield device 100.

Figure 11:
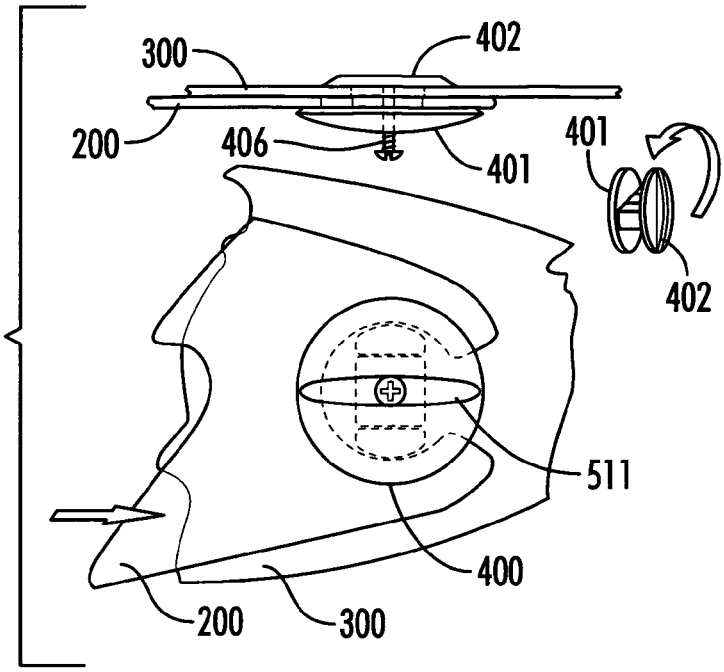
FIG. 11 displays a schematic illustration of the eye shield slot with an alternative engagement bit in a neck retain position.
Figure 12:
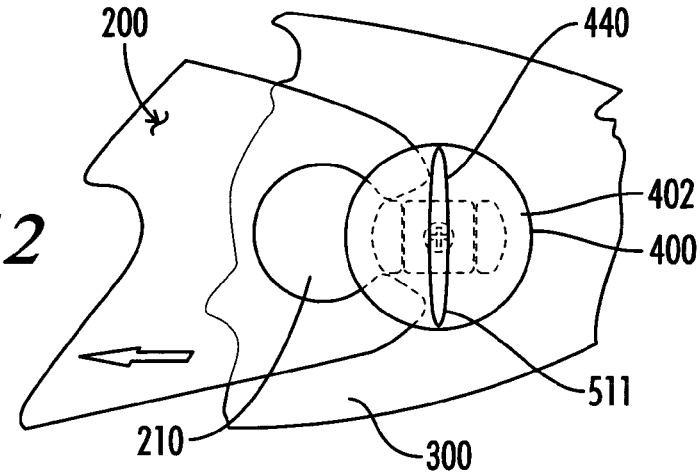
FIG. 12 displays a schematic illustration of the eye shield slot with the alternative engagement bit in a neck release position.
Figure 13:
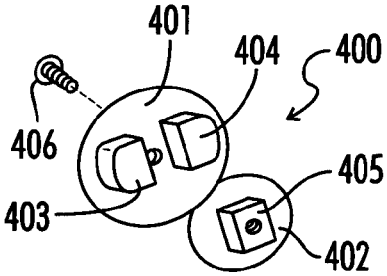
FIG. 13 displays an exploded schematic illustration of the alternative engagement bit.
Figure 14:
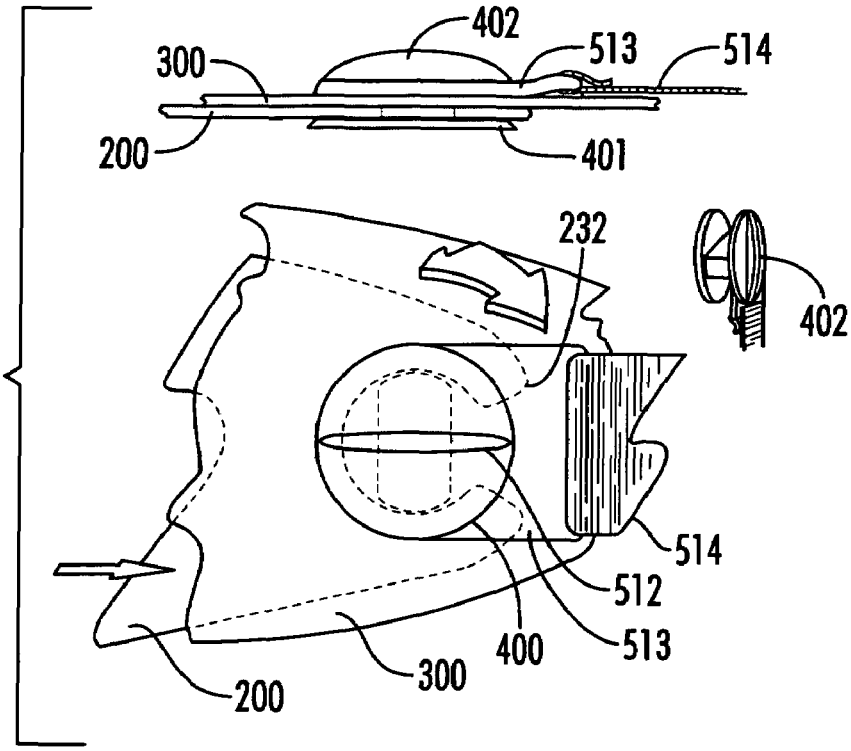
FIG. 14 displays a schematic illustration of the eye shield slot with an alternative engagement bit in a neck retain position.
Figure 15:
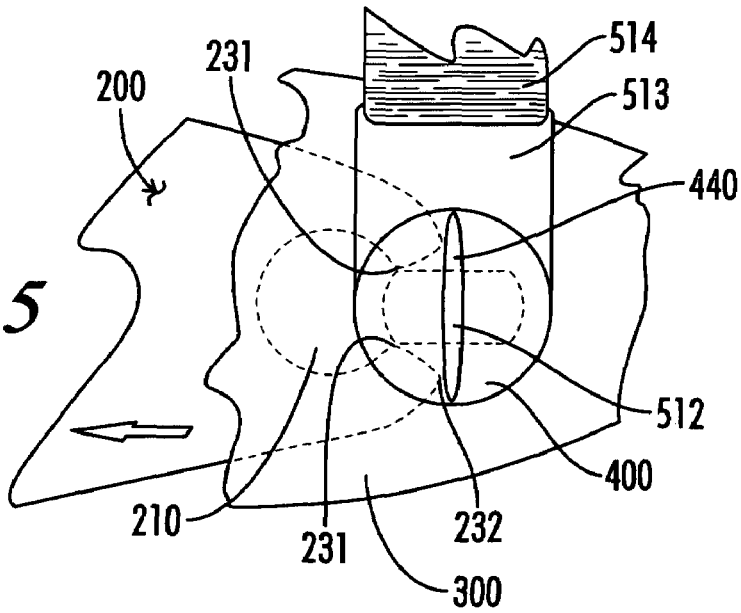
FIG. 15 displays a schematic illustration of the eye shield slot with the alternative engagement bit in a neck release position.
Figure 16:
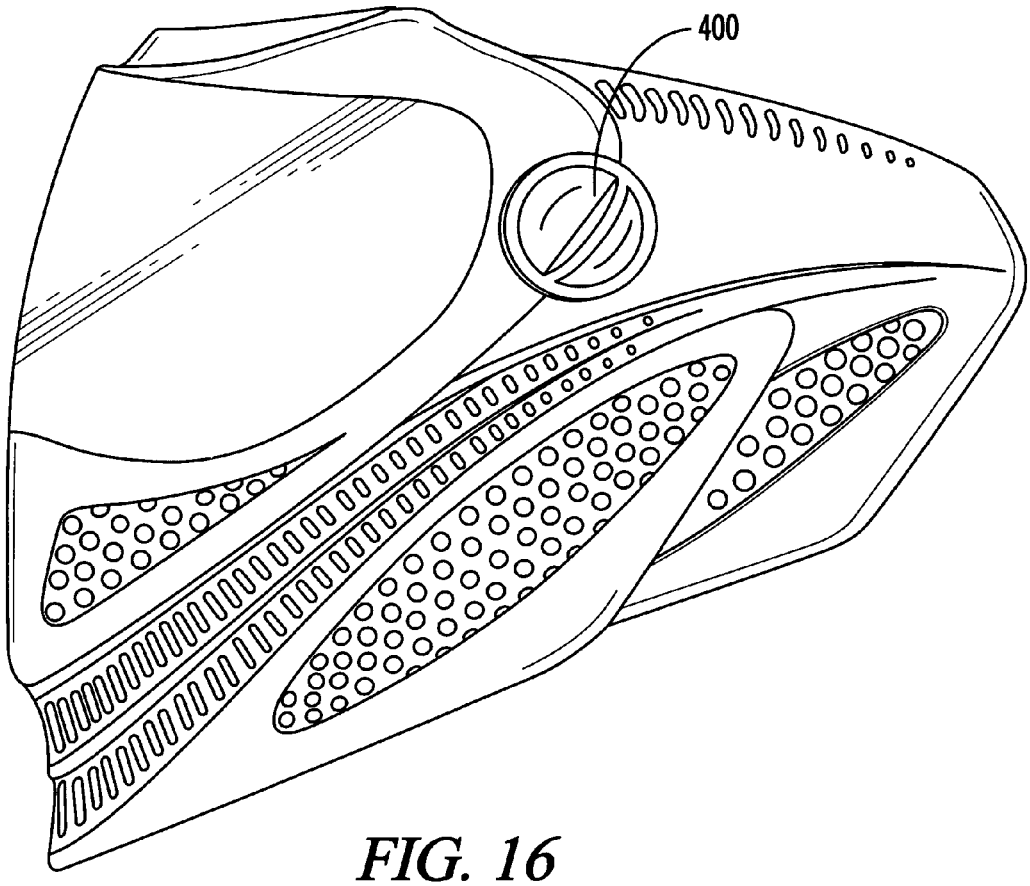
FIG. 16 displays a side plan view of an alternative eye shield device.

In another embodiment of the present invention, an aperture engagement device 400 represents the shield engagement device. The aperture engagement device 400, as illustrated by FIGS. 11-16, comprises an engagement bit 410 and a movement device 440. As shown in FIG. 13, the engagement bit is formed by mating an interior tab 401 with an exterior tab 402 to form the engagement portion of the engagement bit 410. Exterior tab 402 and interior tab 401 both feature mating projections 403, 404, 405 which form the engagement portion of the engagement bit 410. Interior tab 401 features two mating projections 403, 404 which fit around the exterior tab mating projection 405. In this manner, the engagement portion is stabilized and aligned by the interior tab projections 403, 404. A fastener 406, such as a screw or a bolt, may be utilized to secure the exterior tab to the interior tab. For safety, the fastener 406 should point away from the interior of the shield away from a user's head. The engagement portion spaces the tab pieces 401, 402 apart providing an aperture for the eye shield between the tabs 401, 402. As shown in FIGS. 11-12 and FIGS. 14-15, the mating of interior tab 401 and exterior tab 402 forms an aperture which covers the retention aperture of the eye shield. The tabs 401, 402 include overlapping shoulders surrounding the upper finger 220 and lower finger 222 of the eye shield 200. The engagement portion provides a structure with two shorten parallel sides and two longer parallel sides. The eye shield 200 has a retention aperture 210 formed in it for receiving the engagement bit 410. As shown in FIGS. 12 and 15, the when turned with the shorten sides facing the eye shield aperture 210, the engagement bit 410 passes within the engagement aperture 210 where the engagement bit 410 may then be rotated to hold the eye shield 200 in position. The retention aperture 210 of the eye shield 200 represents the engagement area of the eye shield 200. As shown in FIGS. 11 and 14, once the engagement bit 410 is extended through the retention aperture 210, the engagement bit 410 can be adjusted to a neck retain position in order to secure the eye shield 200 to the frame 300.

As shown in FIGS. 11-12, the exterior tab 402 includes a control device 511 for user manipulation of the engagement bit 410 within the shield device. As shown in FIGS. 14-15, the exterior tab 402 includes a control device 512 for user manipulation of the engagement bit 410 from the exterior of the shield device. The control device 511, 512 for the exterior and interior tab 402, 401 may include a ridge, an indentation or a latch for easy manipulation by a user. The control device 511 within the interior of the shield device is preferably low profile to minimize contact with a user's head. The control device 511, 512 is preferably smooth to minimize injury during use.

As shown in FIGS. 14-15, the engagement device 400 further includes an attachment projection 513 attached to the exterior tab 402. The attachment projection 513 is adapted to connect to a strap 514 for use with holding the shield device upon a user's head. As shown in the drawings, when the strap 514 is motivated, the exterior tab 402 additionally is motivate to allow for the engagement bit 410 to be motivated within the eye shield aperture.

The inside of the shield device 100 has a number of die-cut foam liners or pads for the face and head. One of these pads is adhesively or otherwise affixed inside of the shield device 100 to provide padding for the top of the head and so as to not block the air flow through the air vents in the shield device 100. Another one of the pads is adhesively or otherwise affixed to the inside of the shield device 100 so as to provide padding for the face, particularly the cheeks. Still another one of the pads is adhesively or otherwise affixed to the shield device 100 so as to provide padding for the face and particularly the nose.

Accordingly, from the above description, it can be seen that a shield device 100 which is strong, light-weight and relatively inexpensive is provided. The shield device 100 is vented and has foam liners or padding for cushioning the head and face for comfort. The shield device 100 has an eye shield which provides a wide field of vision and can also be easily replaced by a user.

Although the invention has been described above with respect to one specific form, it is evident that it may be varied and refined in various ways. For example, the mask could be modified to suit other physical games, such as ice hockey or sports, such as moto-cross, motorcycling, where protection is required, where the replacement of an eye shield is needed or where hard impact on the eye shield may cause its dislodgement from its actual engagement to the frame. It is therefore wished to have it understood that the present invention should not be limited in scope, except by the terms of the following claims.

What is claimed is:

1. A shield apparatus for protecting a user's head and face, the shield apparatus comprising:
- a frame for protecting a portion of a user's face, the frame having a bottom portion and an eye opening;
- a eye shield removably connected to the frame and covering the eye opening, the eye shield comprising:
  - an aperture neck forming an opening, and
  - a retention aperture having an upper arm and a lower arm forming a retention aperture inward from an aperture neck;
- an aperture engagement device securing the eye shield to the frame, the aperture engagement device comprising:
  - an interior tab;
  - an exterior tab;
  - an engagement bit formed by the interior tab and the exterior tab, the engagement bit having a retention side and a release side, the release side being shorter than the retention side and able to fit through the aperture neck opening;
  - a movable control connected to the exterior tab, the control allowing a user to move the engagement bit from a release position to a retain position, the release position allowing the release side of the engagement bit to pass through the aperture neck opening to connect the eye shield to the frame and the retain position having the retention side perpendicular to the aperture neck opening, thereby preventing movement of the engagement bit through the aperture neck opening.

2. The apparatus of claim 1 including the interior tab and exterior tab having shoulder extensions overlapping the retention aperture.

3. The apparatus of claim 1, the aperture neck having an interior bevel.

4. The apparatus of claim 1, the aperture neck having a larger exterior bevel.

5. The apparatus of claim 1, the interior tab having at least one projection, whereby the at least one projection of the exterior tab mates with the at least one projection of the interior tab to forming the engagement bit.

6. A shield apparatus for protecting a user's head and face, the shield apparatus comprising:
- a frame for protecting a portion of a user's face, the frame having a bottom portion and an eye opening;
- a eye shield removably connected to the frame and covering the eye opening, the eye shield comprising:
  - an aperture neck forming an opening, and
  - a retention aperture having an upper arm and a lower arm forming a retention aperture inward from an aperture neck;
- an aperture engagement device securing the eye shield to the frame, the aperture engagement device comprising:
  - an interior tab;
  - an exterior tab having at least one projection adapted to attach to the interior tab;
  - an engagement bit formed by the interior tab and the exterior tab, the engagement bit having a retention side and a release side, the release side being shorter than the retention side and able to fit through the aperture neck opening;
  - a movable control connected to the exterior tab, the control allowing a user to move the engagement bit from a release position to a retain position, the release position allowing the release side of the engagement bit to pass through the aperture neck opening to connect the eye shield to the frame and the retain position having the retention side perpendicular to the aperture neck opening, thereby preventing movement of the engagement bit through the aperture neck opening.

7. The apparatus of claim 6, the interior tab having at least one projection, whereby the at least one projection of the exterior tab mates with the at least one projection of the interior tab to forming the engagement bit.

8. The apparatus of claim 7, the engagement bit having a fastener adapted to connect the interior tab to the exterior tab.

9. The apparatus of claim 6, the interior tab and exterior tab having shoulder extensions overlapping the retention aperture.

10. A shield apparatus comprising:
- a frame for protecting a portion of a user's face, the frame having a bottom portion covering a user's nose, a side portion, a top portion covering user's brow, and an eye opening;
- a eye shield removably connected to the frame and covering the eye opening, the eye shield comprising:
  - an aperture neck forming an opening, and
  - a retention aperture having an upper arm and a lower arm forming a retention aperture inward from an aperture neck;
- an aperture engagement device securing the eye shield to the frame, the aperture engagement device comprising:
  - an interior tab;
  - an exterior tab having at least one projection adapted to attach to the interior tab;
  - an engagement bit formed by the interior tab and the exterior tab, the engagement bit having a retention side and a release side, the release side being shorter than the retention side and able to fit through the aperture neck opening;
  - a movable control connected to the exterior tab, the control allowing a user to move the engagement bit from a release position to a retain position, the release position allowing the release side of the engagement bit to pass through the aperture neck opening to connect the eye shield to the frame and the retain position having the retention side perpendicular to the aperture neck opening, thereby preventing movement of the engagement bit through the aperture neck opening.

11. The apparatus of claim 10, the interior tab having at least one projection, whereby the at least one projection of the exterior tab mates with the at least one projection of the interior tab to forming the engagement bit.

12. The apparatus of claim 10, the interior tab and exterior tab having shoulder extensions overlapping the retention aperture.

* * * * *